US006775930B2

(12) United States Patent
Fuerst

(10) Patent No.: US 6,775,930 B2
(45) Date of Patent: Aug. 17, 2004

(54) KEY HOLE MIDSOLE

(75) Inventor: Rory W. Fuerst, Atherton, CA (US)

(73) Assignee: Rofu Design, Menlo Park, CA (US)

( * ) Notice: Subject to any disclaimer, the term of this patent is extended or adjusted under 35 U.S.C. 154(b) by 0 days.

(21) Appl. No.: 10/353,720

(22) Filed: Jan. 28, 2003

(65) Prior Publication Data

US 2003/0172548 A1 Sep. 18, 2003

(51) Int. Cl.[7] ..... A43B 13/16
(52) U.S. Cl. ..... 36/103; 36/30 R; 36/28; 12/146 B
(58) Field of Search ..... 36/103, 107, 108, 36/27, 28, 30 R, 25 R; 12/142 P, 146 B, 146 BR

(56) References Cited

U.S. PATENT DOCUMENTS

| | | | | |
|---|---|---|---|---|
| 3,952,427 A | | 4/1976 | von den Benken et al. | |
| 4,291,428 A | * | 9/1981 | Anzani | 12/146 B |
| 4,348,821 A | | 9/1982 | Daswick | |
| 4,428,129 A | | 1/1984 | Jones, Jr. | |
| 4,561,195 A | * | 12/1985 | Onoda et al. | 36/30 R |
| 5,179,791 A | * | 1/1993 | Lain | 36/27 |
| 5,367,791 A | | 11/1994 | Gross et al. | |
| 5,448,840 A | | 9/1995 | Cheskin | |
| 5,664,857 A | | 9/1997 | Lautenschlager et al. | |
| 5,765,295 A | | 6/1998 | Srourian et al. | |
| 5,826,352 A | | 10/1998 | Meschan et al. | |
| 5,832,634 A | | 11/1998 | Wong | |
| 6,314,664 B1 | | 11/2001 | Kita et al. | |
| 6,467,198 B1 | | 10/2002 | James | |
| 6,497,058 B2 | | 12/2002 | Dietrich et al. | |
| 6,502,330 B1 | | 1/2003 | David et al. | |
| 6,684,532 B2 | * | 2/2004 | Greene et al. | 36/28 |

FOREIGN PATENT DOCUMENTS

| | | |
|---|---|---|
| WO | WO 96/39061 | 12/1996 |

* cited by examiner

*Primary Examiner*—Ted Kavanaugh
(74) *Attorney, Agent, or Firm*—Foley & Lardner LLP

(57) ABSTRACT

A midsole assembly for an article of footwear having a heel, a midsection and a forefoot. The midsole includes a first member having a first hardness and forming a continuous heel support, shank, and forefoot plate. A second member having a second hardness forms a continuous heel cushion and forefoot cushion. The first member is positioned beneath the second member in the heel, and positioned above the second member in the forefoot.

39 Claims, 14 Drawing Sheets

KEY HOLE MIDSOLE

FIELD OF THE INVENTION

The present invention relates to an article of footwear including a midsole design and construction. More particularly, the invention relates to a midsole assembly having a key hole construction.

BACKGROUND OF THE INVENTION

Traditionally, shoes and boots are fabricated by shaping the footwear over a last. A last is a three-dimensional shape of the inside cavity of a boot or shoe. The last may be mounted upside down for ease of manipulation and assembly of the components making up the footwear. The upper and sole are generally placed over the last in pieces or assemblies and secured together. A preassembled component upper consists of various layers of fabric and/or leather material sewn and/or glued together to form the upper or a portion of the upper shoe. Occasionally, the upper or sole are reinforced with rigid components, which have the general configuration of the finished product but have not yet been shaped to the final form of the footwear.

The rigidity and flexibility characteristics of the footwear are achieved by interposing the various layers of materials having suitable mechanical properties in specific regions of the footwear. In one typical assembly process, an insole is positioned on the top portion of the inverted last, which represents the inside bottom part of the article of footwear and the preassembled fabric component is then positioned over the last. The fabric components are stretched over the last and pushed over the insole to conform to the specific shape of the last and then nailed, tacked, and/or glued to the insole to maintain the desired shape. Often rigid plastic components are added to the sole construction to increase the strength and support of the footwear in specific areas. The footwear is usually completed with a midsole or cushioning and then an outsole nailed, tacked and/or glued to the assembly of components on the last.

Today, the sole design for modern athletic footwear for running, hiking and walking is characterized by a multilayer construction comprising an outsole, midsole, and insole. The midsole is typically composed of a soft, foam material which provides cushioning properties to the shoe. However, a midsole formed from only a soft foam material is often ineffective for not only athletic shoes for running and other related sports, but also for hiking boots and other shoes used in an active lifestyle. Specifically, if the midsole is formed only of a soft foam material, the shoe can have excessive deformation which can lead to injuries. In addition, soft foam materials also impart instability that increases in proportion to midsole thickness. For this reason, footwear design often involves a balance of cushioning elements and stability elements.

In order to better understand the balancing of cushioning and stability in an athletic shoe, it is necessary to understand the general motion of the foot impacting the ground. First, the heel strikes the ground, followed by the ball of the foot. As the heel leaves the ground, the foot rolls forward so that the toes make contact, and finally the entire foot leaves the ground to begin another cycle. During the time that the foot is in contact with the ground, it typically rolls from the outside or lateral side to the inside or medial side, a process called pronation. Thus, normally, the outside of the heel strikes first with the toes on the inside of the foot leaving the ground last. While the foot is air borne and preparing for another cycle the opposite process, called supination, occurs. Although the inward roll of the foot in contact with the ground, although normal, pronation can be a potential source of foot and leg injury, particularly if it is excessive.

In order to help reduce injuries caused by pronation, soft foam materials were added to the midsole. However, as set forth above, the use of soft cushioning materials in the midsole of running shoes, while providing protection against impact forces, resulted in instability of the ankle, thereby contributing to the tendency for over-pronation and other athletic injuries.

In addition to the control of pronation, athletic footwear includes another type of foot motion requiring an article of footwear having stability. This type of motion is lateral, sideways or cutting movements. An athlete or someone involved in an active lifestyle may be required to perform a variety of motions including movement to the side, quickly executed direction changes, and stops and starts. While making such movements, if the midsole is not stable, the individual may suffer excessive inversion or eversion of the ankle joint, otherwise known as an ankle sprain.

Accordingly, stability as well as adequate cushioning properties are required in athletic shoes including walking and running shoes and hiking boots. Thus, there is a need for a midsole construction which prevents the midsole from excessively being deformed when contacting with the ground while providing adequate cushioning. It is therefore an object of the present invention to provide an article of footwear, in particular a sports shoe, where the article of footwear has an improved stability with cushioning properties.

SUMMARY OF THE INVENTION

In accordance with one aspect of the present invention, a midsole assembly for an article of footwear having a heel, a midsection and a forefoot, the midsole including a first member having a first hardness, the first member forming a continuous heel support, shank, and forefoot plate; a second member having a second hardness, the second member forming a continuous heel cushion and forefoot cushion; and wherein the first member is positioned beneath the second member in the heel, and positioned above the second member in the forefoot.

In accordance with another aspect of the present invention, a midsole assembly for an article of footwear having a heel, a midsection, and a forefoot, the midsole including a semi-rigid member, the semi-rigid member forming a heel support, a shank, and a forefoot plate; and a foam member, the foam member forming a cushion portion in the heel and forefoot, the semi-rigid member is positioned beneath the foam member in the heel and the midsection, and wherein the semi-rigid member is positioned above the foam member in the forefoot.

In accordance with a further aspect of the present invention, a midsole assembly for an article of footwear having a heel, a midsection, and a forefoot including a first member having a first hardness, the first member forming a heel support and forefoot plate; a second member having a second hardness, the second member forming a cushion in the heel and forefoot; and wherein the first member is positioned beneath the second member in the entire heel region and positioned above the second member in the entire forefoot region.

In accordance with another aspect of the present invention, an article of footwear including an upper for receiving a foot of a wearer; a midsole assembly, the midsole assembly including a first member, the first member forming a continuous heel support, shank and forefoot plate; and a second member, the second member forming a continuous heel cushion and forefoot cushion, wherein the first member is positioned beneath the second member in the heel, and positioned above the second member in the forefoot; and an outsole.

In accordance with another aspect of the present invention, an article of footwear including an upper for receiving a foot of a wearer; a midsole assembly, the midsole assembly including a semi-rigid member, the semi-rigid member forming a heel support, a shank and a forefoot plate; and a foam member, the foam member forming a cushion portion in the heel and forefoot, wherein the semi-rigid member is positioned beneath the foam member in the heel and the shank, and positioned above the foam member in the forefoot; and an outsole.

In accordance with a further aspect of the present invention, a method of assembling a midsole for an article of footwear including the steps of forming a first member having a heel support, a shank, and a forefoot support; forming a second member providing cushioning in the heel and forefoot, the second member having an opening in a mid portion of the second member for positioning the first member through the second member; inserting the first member through the opening in the second member, wherein the first member is positioned beneath the second member in the heel and middle of the midsole and positioned above the second member in the forefoot; and combining the first member and second member to form a midsole assembly.

In accordance with a further aspect of the present invention, a method of assembling a midsole for an article of footwear including the steps of forming a semi-rigid member having a heel support, a shank, and a forefoot support; forming a soft foam member providing cushioning in the heel and forefoot, the soft foam member having an opening in a mid portion of the soft foam member for positioning the semi-rigid member through the soft foam member; inserting the semi-rigid member through the opening in the soft foam, wherein the semi-rigid member is positioned beneath the soft foam member in the heel and middle of the midsole and positioned above the soft foam member in the forefoot; and combining the semi-rigid member and soft foam member to form a midsole assembly.

Still other objects, features, and attendant advantages of the present invention will become apparent to those skilled in the art from reading of the following detailed description of embodiments constructed in accordance therewith, taken in conjunction with the accompanying drawings.

BRIEF DESCRIPTION OF THE DRAWINGS

This invention will be further described with reference being made to the accompanying drawings in which.

DETAILED DESCRIPTION

Figure 1:
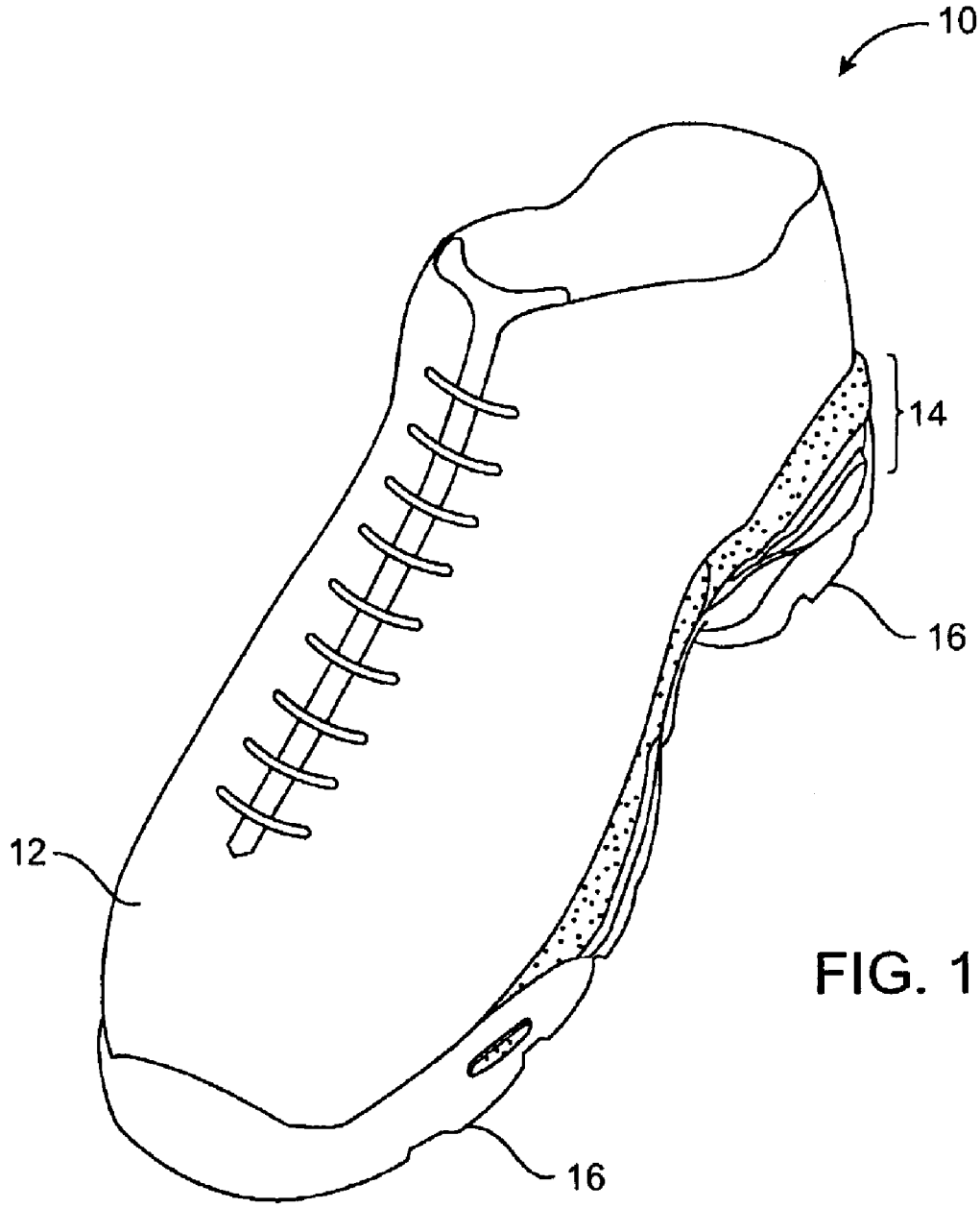
FIG. 1 is a perspective view of an article of footwear according to one embodiment of the present invention.

Referring to the drawings, wherein like numerals indicate like elements, an article of footwear in accordance with the present invention is illustrated. The accompanying figures illustrate the article of footwear intended for use on the right foot of a wearer. The preferred embodiment also includes a left article of footwear, such footwear being the mirror image of the right.

Turning to the drawings, an article of footwear 10 in accordance with one exemplary embodiment of this invention is shown in FIG. 1. The article of footwear 10 includes an upper 12, an insole (not shown), a multi-part midsole 14, and an outsole 16. The outsole 16 directly contacts the ground. Those skilled in the art will further appreciate that the present invention could take the form of the article of footwear 10 depicted or, alternatively, the footwear could be a walking shoe, hiking boot, running shoe, or other footwear for active use.

The upper 12 or top part of the shoe covers the top of the foot. The upper 12 is usually made of nylon, canvas, leather, or other synthetic material. For example, if the upper 12 is used for a hiking boot, it will preferably have a water resistant, highly durable upper 12. On the other hand, a running shoe is typically constructed from nylon or synthetic materials. In one particular example of the invention, the upper 12 is preferably made of a combination of leather and synthetic material. However, it can be appreciated that the upper 12 can be made of any combination of nylon, canvas, leather, or other synthetic material depending on the type of footwear.

Figure 2:
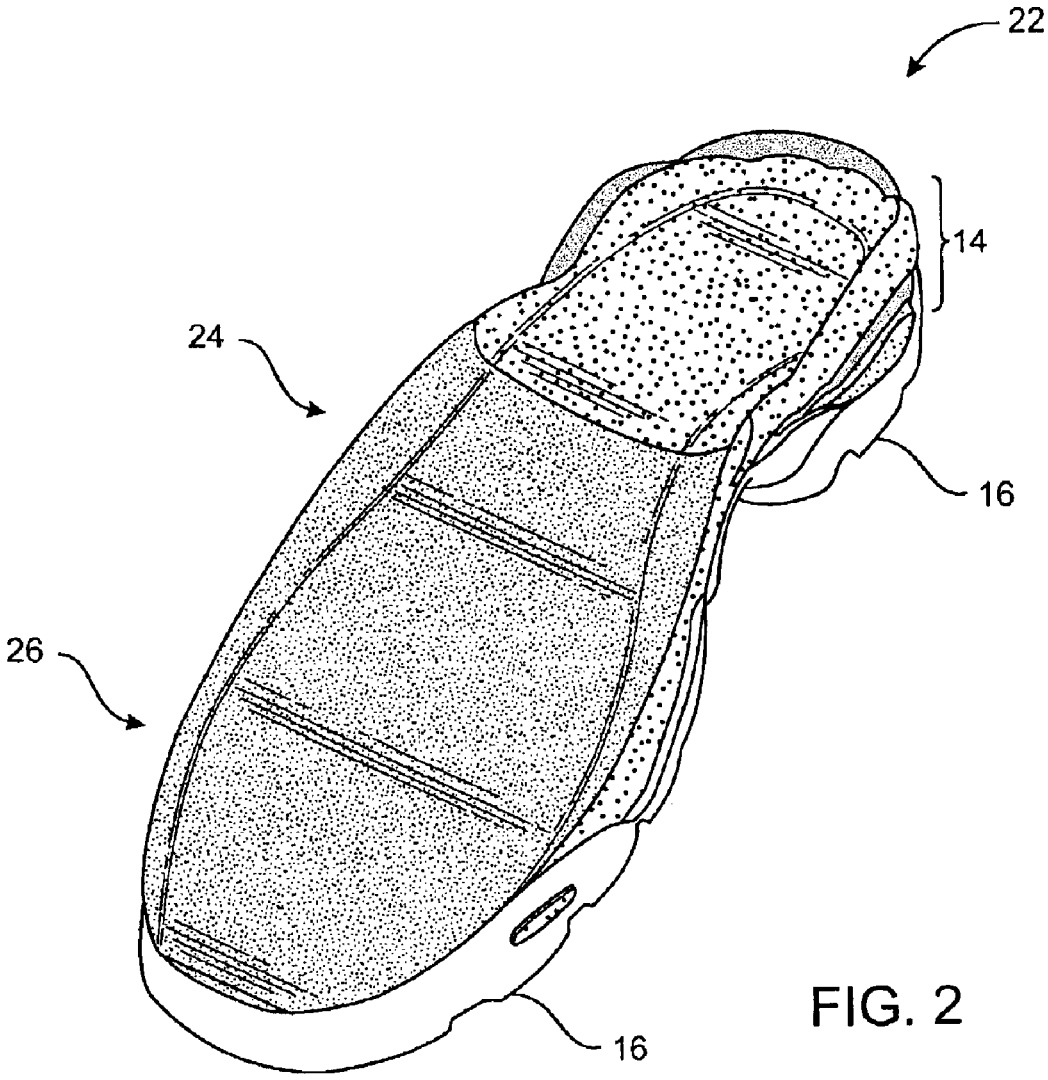
FIG. 2 is a perspective view of the assembled sole for the article of footwear of FIG. 1 showing the midsole and outsole.

FIG. 2 is a perspective view of the midsole 14 and outsole 16 of FIG. 1. The midsole 14 and outsole 16 are generally described as having three separate sections including a heel 22, a midsection 24, and a forefoot 26.

The midsole 14 absorbs the shock or load imparted as the heel 20 of the article of footwear contacts the ground. The midsole 14 includes a plurality of soft foam elements to provide cushion to the article of footwear and a semi-rigid element to provide stability. The semi-rigid element also assists with continuous and smooth movement of the foot from the first contact of the heel until the final push off with the forefoot and toes. The soft foam elements of the midsole 14 will typically have a greater thickness in the heel of the article of footwear than the forefoot portion, due to the fact that the heel of the foot initially contacts the ground, before the forefoot portion.

Figure 3:
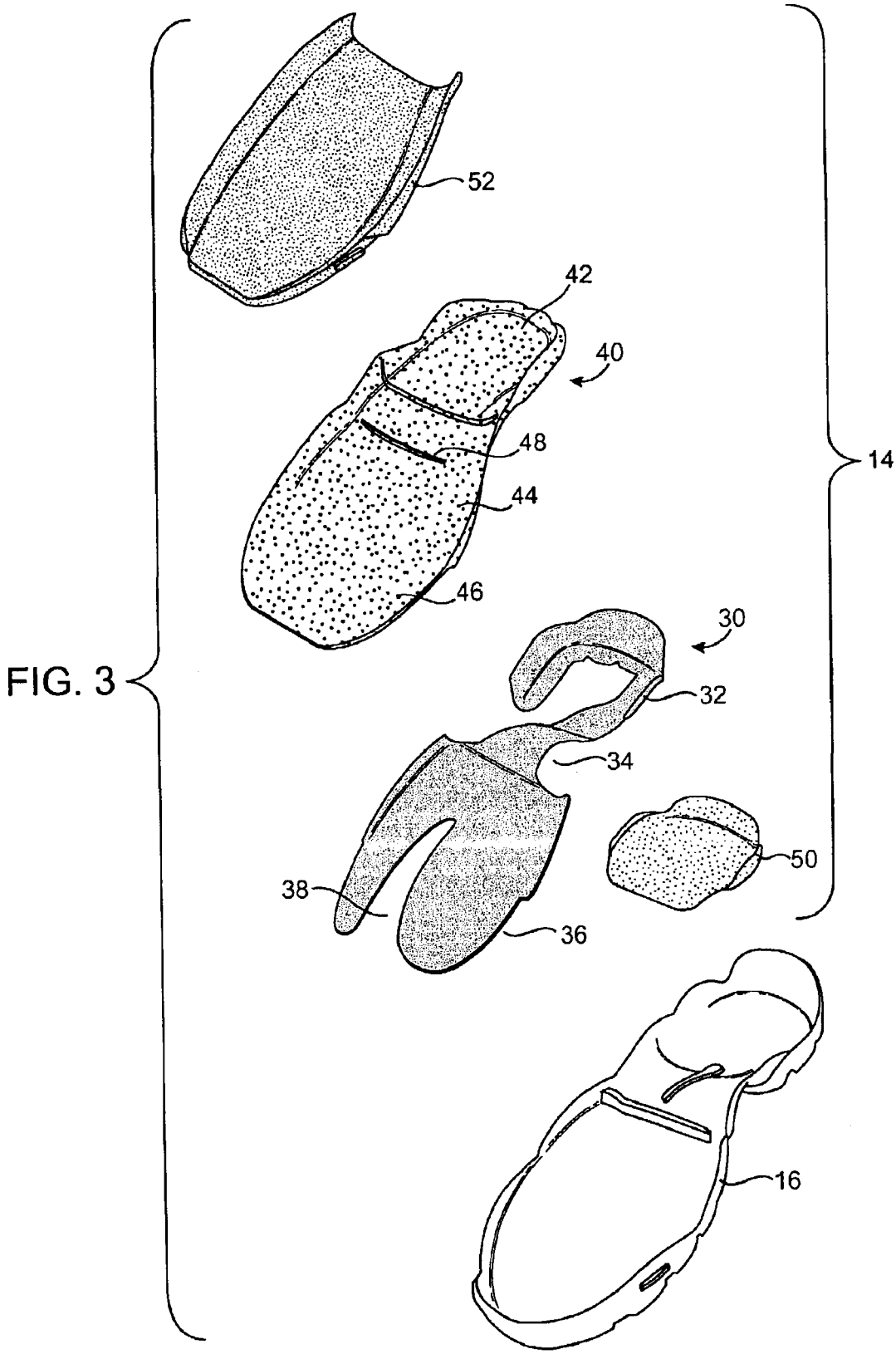
FIG. 3 is an exploded perspective view of the midsole and outsole of FIG. 2.

FIG. 3 shows an exploded view of the midsole 14 and outsole 16 in accordance with one embodiment of the present invention. The midsole 14 includes a first member 30 having a first hardness. The first member 30 forms a heel support 32, a shank 34, and a forefoot plate 36. A second member 40 having a second hardness forms a heel cushion 42, and a forefoot cushion 46. When the midsole 14 is assembled the first member 30 is positioned beneath the second member 40 in the heel 22 and midsection 24, and positioned above the second member 40 in the forefoot 26 by means of a keyhole 48.

Figure 7:
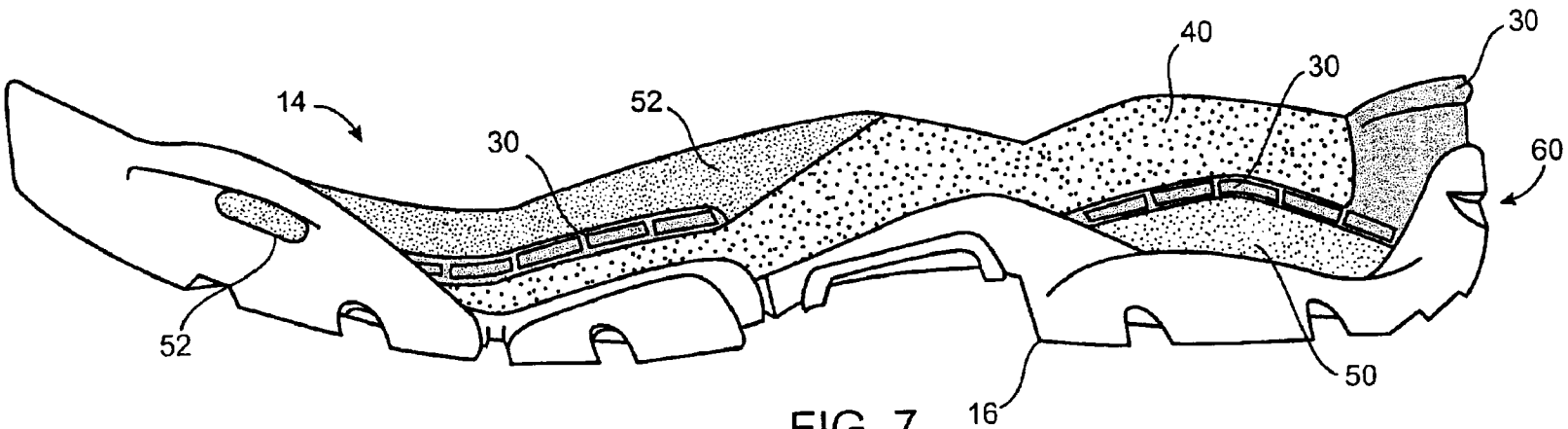
FIG. 7 is a side view of the medial side of the midsole and outsole construction according to FIG. 2.
Figure 8:
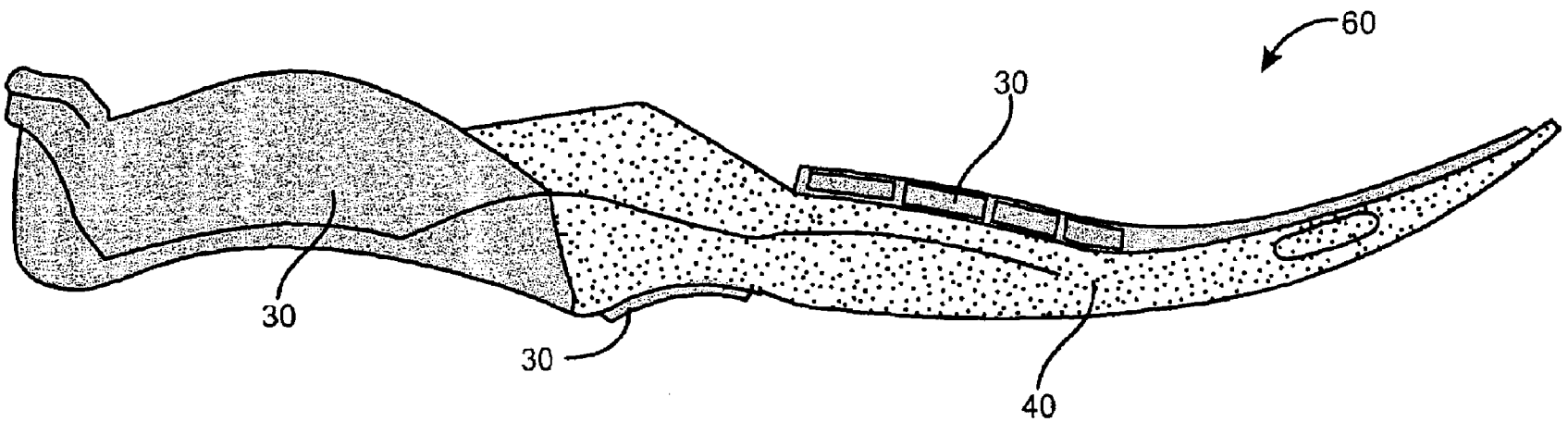
FIG. 8 is a side view of the lateral side of a portion of the midsole of FIG. 2.

The heel support 32 of the first member 30 provides motion control and prevents oscillation of the foot. The heel support 32 as depicted in FIG. 3 is molded as a semi-rigid component that completely encompasses the heel of the shoe extending around the back and two sides of the heel. The heel support 32 has a raised surface that cups the heel of the foot. When assembled with the back portion of the second member 40, the heel cushion 42 of the second member 40 also has a slight cup shape and rests on top of the heel support 32. The back of the heel support 32, however, extends above the raised rear edges of the second member 40. The heel support 32 can be hollow as depicted in FIG. 3 or solid (not shown) and still provide the necessary support to prevent oscillation of the foot while walking or running. The heel support 32 also is visible to the purchaser on the exterior of the sole, as shown in FIGS. 7 and 8, and influences the design of the article of footwear 10.

The first member 30 also includes a forefoot plate 36 which provides stability to the article of footwear in unison with the shank 34 and heel support 32. The forefoot plate 36 also provides a means for protecting the foot from sharp objects including stones, thorns, needles, or other sharp objects found in the outdoors. The forefoot plate 36 has generally an oval shape which mirrors the shape of the wearer's forefoot. As shown in FIG. 3, the forefoot plate 36 is generally solid with a small wedge-shaped section 38 removed from the oval extending from the front of the forefoot plate 36 near the toes and extending rearward. It can be appreciated that the forefoot plate section can be solid and provide the same benefits.

Figure 5:
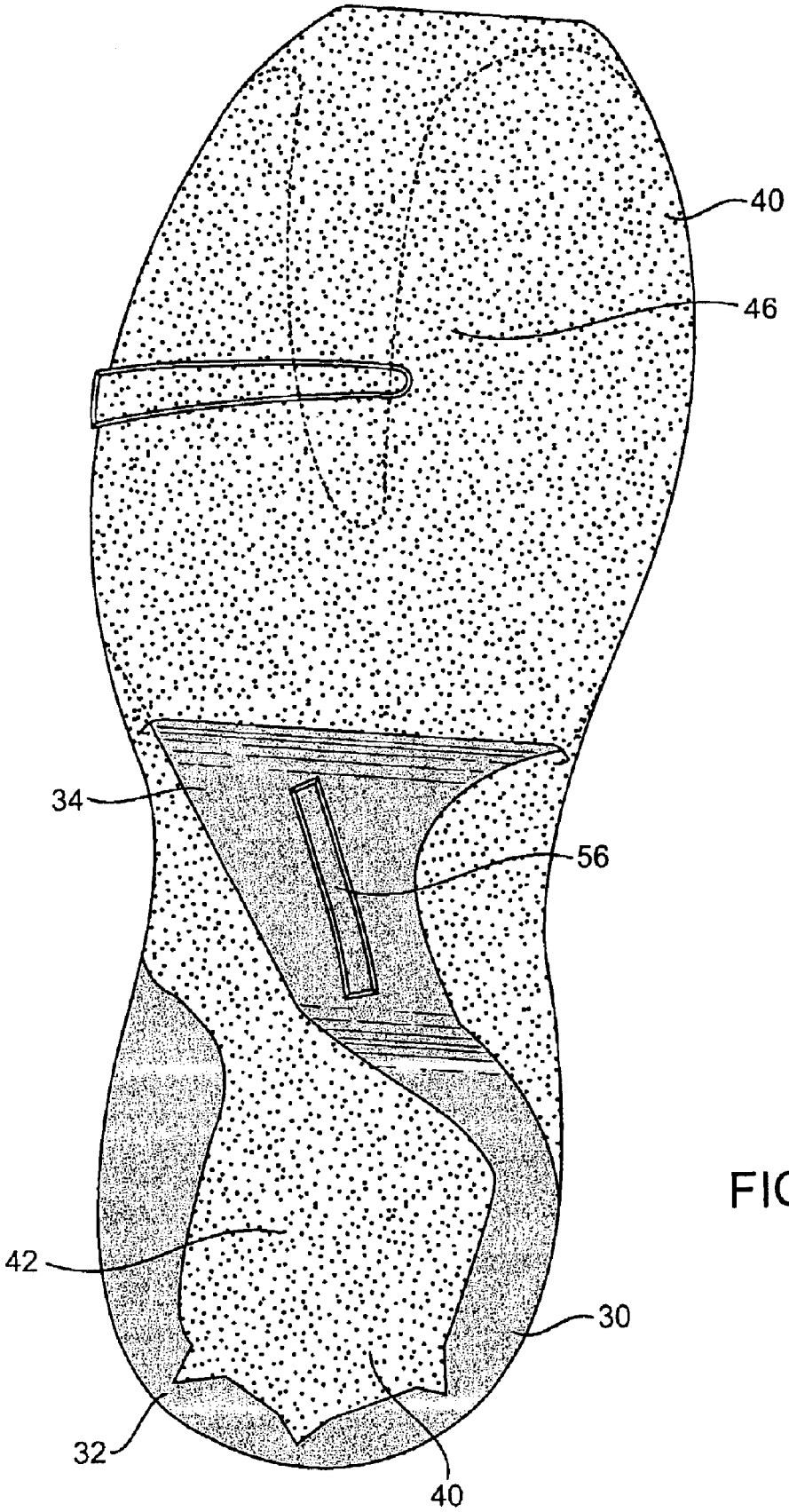
FIG. 5 is a bottom plan view of a portion of the midsole of FIG. 2.

The shank 34 is located between the heel support 32 and forefoot plate 36 at the midsection 22 of the first member 30. Generally, the shank 34 is the narrowest part of the article of footwear and corresponds with the instep or arch of the foot. The shank 34 provides stability to the article of footwear underneath the arch of the wearer by preventing the article of footwear from flexing at the midsection 22. As shown in FIG. 5, the shank 34 preferably includes a rib 56 (on the underneath side) of the first member 30 which appears rectangular in the bottom views of FIG. 5. However, it can be appreciated that the shank 34 can be any type of rigid material added to the article of footwear. The shank 34 functions to prevent significant collapse of the wearer's arch. In addition, the shank prevents the article of footwear from bending in the waist or midsection, and insures that the article of footwear bends at the tread line. The tread line is the indeterminate area across the trend where the foot bends when standing on one's toes.

The first member 30 is preferably one piece for torsion control. By manufacturing the first member 30 in one piece, the forefoot plate 36 is able to provide some stability, while the shank 34 and heel support 32 provide maximum stability during walking or running activities. If the first member 30 is manufactured as two separate pieces including a separate forefoot plate 36 and a separate heel support 32, the first member loses stability in both the forefoot and heel of the article of footwear. Accordingly, the one-piece design provides the needed torsion control and stability that a two-piece forefoot plate and heel support does not provide.

The first member 30 is formed of a semi-rigid or rigid material providing stability in the heel and midsection with protection in the forefoot from sharp items including rocks and other items frequently encountered in outdoor activities. The first member 30 is preferably a thermoplastic resin such as thermoplastic polyurethane (TPU) of comparatively rich elasticity, polyimide elastomer (PAE), ABS resin, or the like. Alternatively, the first member can be formed from a thermosetting resin such as an epoxy resin, an unsaturated polyester resin or the like. The first member 30 preferably has a durometer of approximately 45 to 75 Shore D. However, it can be appreciated that the durometer of the first member 30 can be approximately 25 to 95 Shore D depending on the type of footwear.

Alternatively, the first member 30 can be a composite material of carbon fiber embedded into a matrix of resin or the like.

The second member 40 having a second hardness forms a heel cushion 42 and a forefoot cushion 46. Preferably, the second member 40 is a single piece of a soft foam type material having the key hole 48. It can be appreciated, however, that the second member 40 can be a separate heel cushion and forefoot cushion.

The second member 40 is preferably formed of a soft, foam-like material, such as a thermoplastic synthetic resin foam, such as an ethylene-vinyl acetate copolymer (EVA), thermosetting resin foam, such as polyurethane (PU), or rubber material foam, such as butadiene or chloroprene rubber. It will be appreciated that the materials as set forth herein are not limiting and that the first member 30, and second member 40 comprising the midsole 14 and the articles of footwear as described herein work with a wide range of materials.

The hardness of the second member 40 is preferably less than the first member 30. The second member 40 while softer than the first member 30 is a relatively firm foam material having a hardness of approximately 50 to 70 on the Asker C scale. However, the second member can be from a relatively softer foam material having a hardness of approximately of 40 to 60 on the Asker C scale.

In a preferred embodiment of the present invention, the second member 40 is a single piece of foam-like material having an opening or key hole 48 located in the waist or shank area 44. Generally, the waist or shank area 44 is defined as the narrow part of the shoe sole or insole underneath the arch of the foot. When the first member 30 and second member 40 are assembled, the first member 30 is positioned beneath the second member 40 in the heel 22 and midsection 24, and positioned above the second member 40 in the forefoot 26. The second member 40 preferably completely surrounds the first member 30 at the keyhole 48 when the first and second members 30, 40 are assembled. However, it can be appreciated that the first and second members 30, 40 can be assembled by sliding the first member 30 into the opening or key hole 48 through a slot extending from the opening 48 to the edge of the second member 40. It can be appreciated that any construction which results in the two continuous members 30, 40 being positioned wherein the first member 30 is positioned beneath the second member 40 in the heel 22, and positioned above the second member 40 in the forefoot 26 can be utilized.

In the preferred embodiment, the first member 30 (as shown in FIGS. 10–14) and the second member 40 are combined to form a key hole assembly 60. The key hole assembly 60 provides both cushioning and protection from stones in the forefoot, and cushioning and stability in the heel in the midsole assembly. Typically in midsole assemblies, the soft foam member and the semirigid member would be a single layer of foam on top of a semi-rigid material or a layer of a semi-rigid material on top of a foam layer. In either scenario, the article of footwear loses either stability in the heel or a loss of cushioning in the heel and forefoot. Thus, by utilizing a key hole assembly 60, the midsole 14 is able to transmit cushioning to the entire foot.

In addition to the key hole assembly 60, in an exemplary embodiment of the present invention, the midsole 14 includes a first cushion member 50, shown in FIG. 3, and a second cushion member 52 providing added cushioning to the midsole 16. The first cushion member 50 is located in the heel portion 22 of the midsole 16. The second cushion member 52 is located in the forefoot portion 26 of the midsole 14. When the midsole 14 is assembled the first cushion member 50 is positioned beneath the first member 30 and above the outsole 16. Meanwhile, the second cushion member 52 is positioned above the first member 30 in the forefoot 26 and beneath the insole. It can be appreciated that the first and second cushion members 50, 52 can be positioned at various positions of the midsole 14 and provide the added cushioning desired by the wearer or may be omitted entirely.

The first cushion member 50 and the second cushion member 52 are preferably a relatively soft foam material having similar properties to the second member with a hardness of approximately 40 to 60 on the Asker C scale. It can be appreciated that the hardness of the first cushion member 50 and the second cushion member 52 can be either softer than the second member 40 or relatively firmer than the second member 40 depending on the stability and cushioning desired in the article of footwear.

The materials used for the first member 30, second member 40, the first cushion member 50 and the second cushion member 52 will preferably have a color additive or dye so that each member has a different visual appearance. However, it can be appreciated that if the visual appearance of the first member 30, second member 40, the first cushion member 50, and the second cushion member 52 is not visible or important to the design of the article of footwear, a color additive or dye may not be added.

Figure 4:
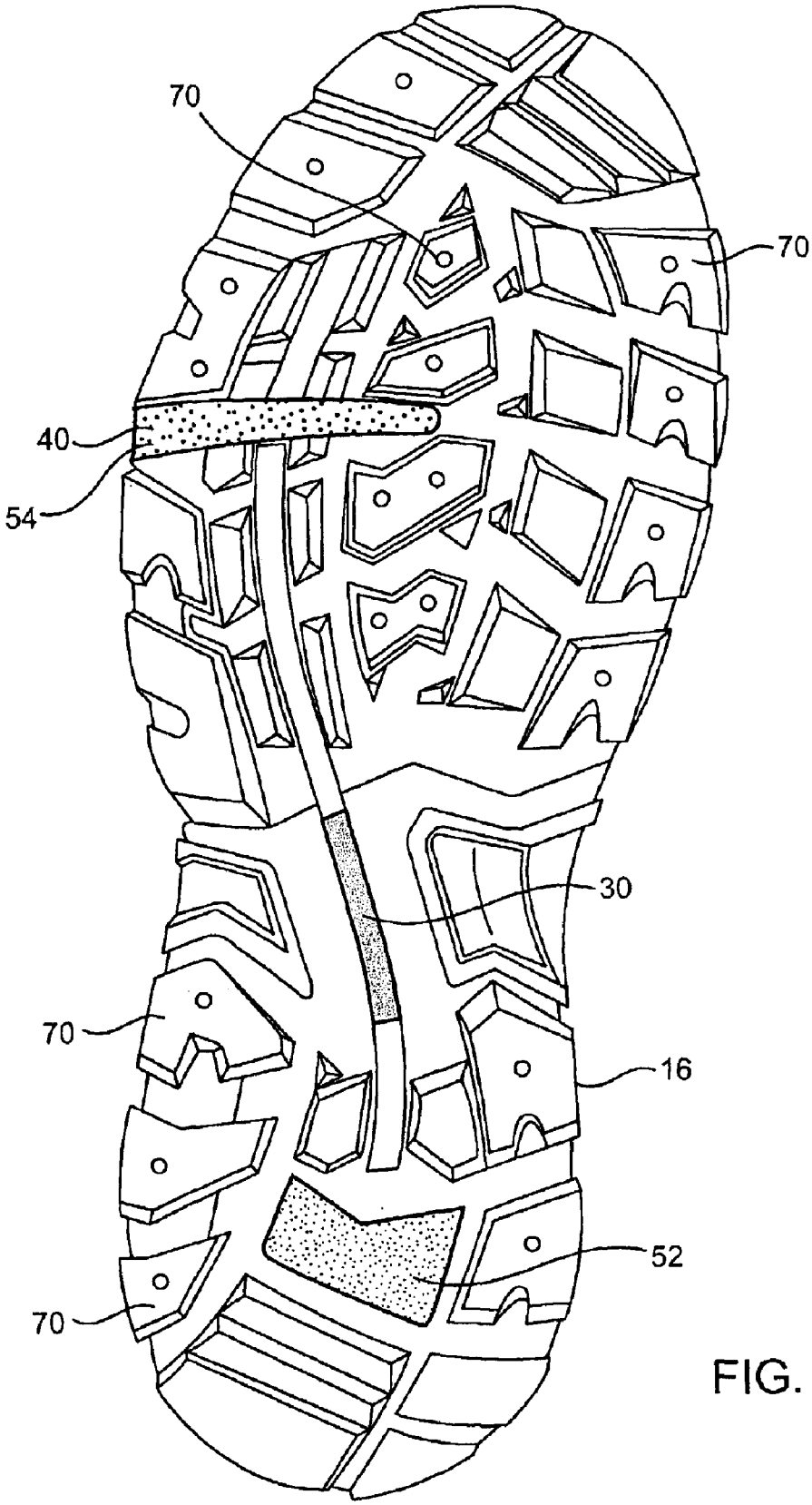
FIG. 4 is a bottom plan view of an outsole according to one embodiment of the present invention.

FIG. 4 is a bottom view of the outsole 16 of the article of footwear of FIGS. 1 and 2. As shown, the outsole 16 has a number of traction elements 70 spaced about the bottom of the outsole 16. The outsole 16 is typically constructed from a rubber or synthetic material providing a slip resistant surface. Examples of rubber or synthetic materials for the outsole 16 include materials with rubber-elastic properties, such as natural or synthetic rubber, synthetic resinous material made of rubber-elastic by the addition of suitable hardeners, preferably on the basis of polyurethane, epoxy resins, or the like. The outsole 16 will have a durometer of approximately 25 to 75 Shore D depending on the article of footwear. If a soft or flexible outsole 16 is desired for certain types of footwear in which flexibility is a major requirement, i.e., running shoes, causal shoes, slippers and the like, the hardness of the outsole will generally not exceed 50 Shore D. However, if a firmer outsole 16 is desired for work boots, utility and safety shoes, a hardness of greater than 50 Shore D is often used.

As seen in FIG. 4, portions of the midsole 14 are visible to the purchaser of the article of footwear and serve not only as a means for marketing by allowing the purchaser to view the important structural features of the shoe, but also as a design influence by adding different colors and textures to the outsole 16. In the forefoot 26 of the outsole 16, the second member 40 is visible. Meanwhile, in the midsection or shank 24, the reinforced rib 56 of the shank 34 of the first member 30 is visible to the purchaser. In the heel 22, the first cushion member 50 is visible. It can be appreciated that the outsole 16 as shown in FIG. 4 is only one of several designs for the outsole 16. For example, U.S. Design patent application Nos. 29/162,882 and 29/162,883, filed on Jun. 19, 2002, show several outsoles 16 that could be used with an article of footwear as described herein and are incorporated in their entirety by reference.

FIG. 5 shows a bottom plan view of the key hole assembly 60. As shown in FIG. 5, the key hole assembly 60 includes the first member 30 and the second member 40. The first member 30 includes a heel support 32 visible on the bottom of the key hole assembly 60, a forefoot plate 36 (not visible), and the shank 34. The shank 34 includes a rib 42. However, it can be appreciated that the shank 34 can be any shape as long as it provides the needed stability to the mid portion of the article of footwear 10. The second member 40 of the key hole assembly 60 provides cushioning to the midsole 14. As shown in FIG. 5, the first member 30 is located beneath the second member 40 in the heel and midsection/waist 24 area and above the second member in the forefoot area 26. The second member 40 also includes a protruding segment 54 which protrudes into the outsole 16 and is visible in FIG. 4.

Figure 6:
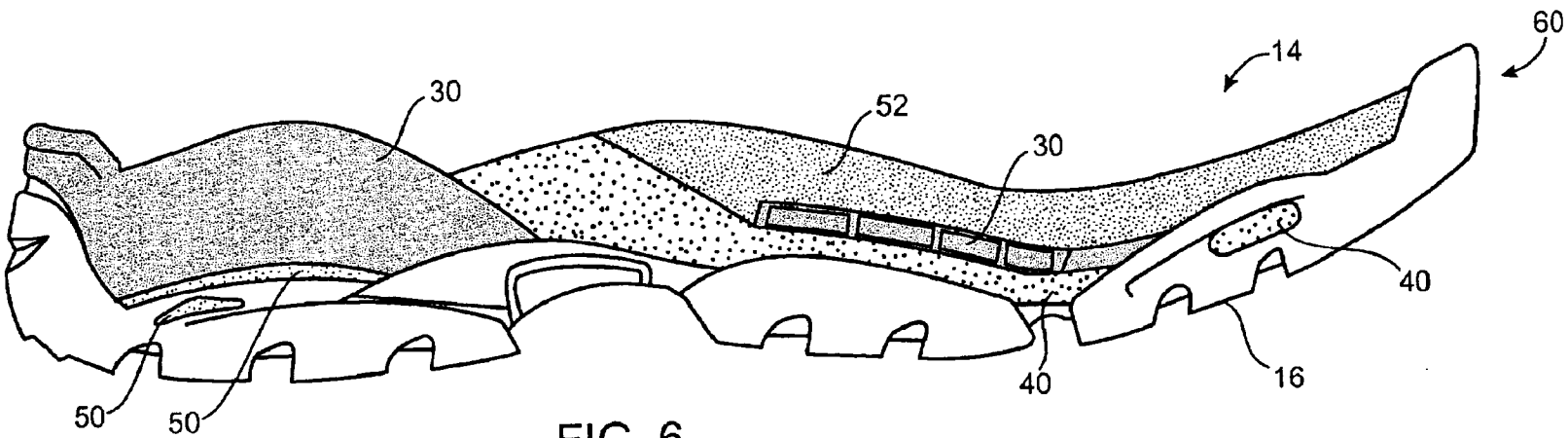
FIG. 6 is a side view of the lateral side of the midsole and outsole construction according to FIG. 2.

FIG. 6 shows a lateral view (the outer side of the foot) of the midsole 14 and outsole 16. As shown in FIG. 6, the lateral side of the midsole 14 and outsole 16 when assembled provides an excellent visual of the layers of the midsole 14 to the wearer. The outsole 16 has a plurality of openings where the first member 30, the second member 40, the first cushion member 50, and the second cushion member 52 are visible to the wearer. Although the ability to visually see the midsole 14 does not provide an additional structural benefit over and above what has been previously described, the plurality of openings provide both an aesthetic appearance and confirmation to the purchaser of the composition of the midsole 14. In addition, the various materials used to manufacture the midsole 14 provides an influence on the design of the article of footwear.

FIG. 7 shows a medial view (the inside of the foot) of the midsole 14 and outsole 16. As described above, the outsole 16 has a plurality of openings where the first member 30, the second member 40, the first cushion member 50, and the second cushion member are visible to the wearer.

FIG. 8 is a view of the heel of the midsole 14 and outsole 16. The midsole 14 and outsole 16 in the heel includes the first member 30, the second member 40, and the cushion member 50. In the heel, the outsole 16 is prominent to provide sufficient protection to the midsole 14 as result of the additional and forceful impact to the heel of the shoe.

Figure 9:
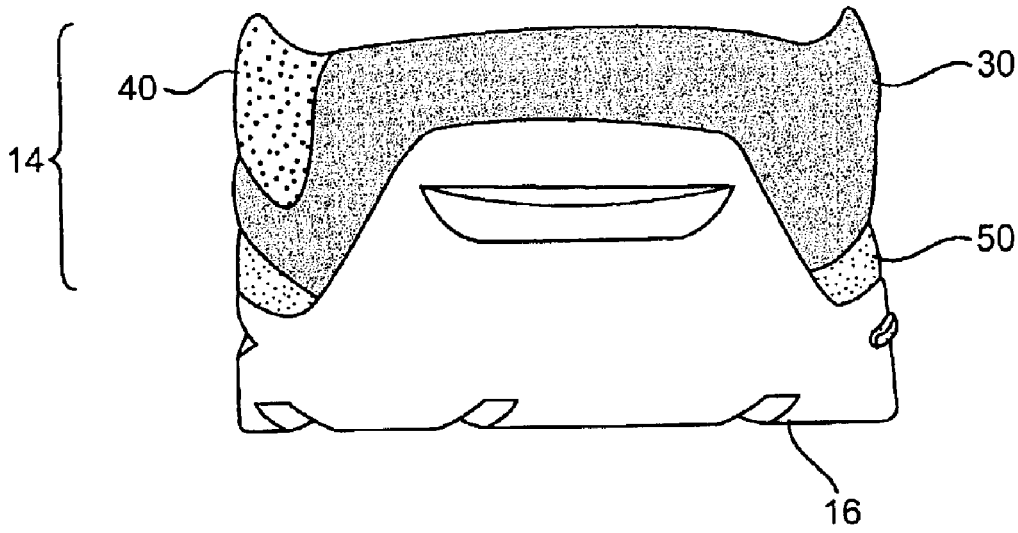
FIG. 9 is an end view of the heel portion of the article of footwear of FIG. 2.

FIG. 9 shows a side view of the lateral side of the key hole midsole 60. As shown, the first member 30 is positioned beneath the second member 40 in the heel, and positioned above the second member 40 in the forefoot. The first member 30 is also positioned beneath the second member 40 in the shank.

Figure 10:
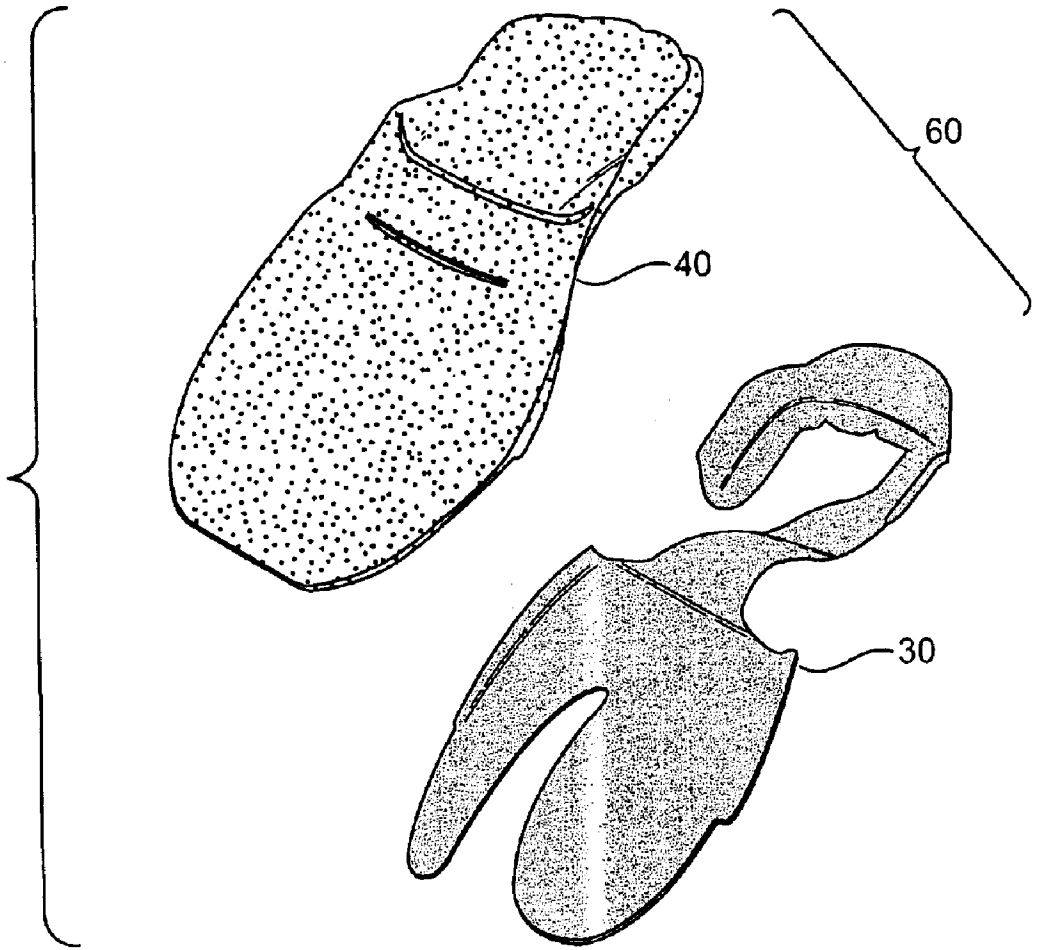
FIGS. 10–14 are a series of perspective views of the key hole midsole and the method of assembly of the key hole midsole.

FIGS. 10–14 show a method of assembling a midsole for an article of footwear. As shown in FIG. 10 the method includes forming a first member 30 having a heel support 32, a forefoot support 36, and a shank 34. A second member 40 provides cushioning in the heel and forefoot by forming a heel cushion 42 and a forefoot cushion 46. The second member 40 has an opening 48 in a mid portion 44 of the second member 40 for positioning the first member 30 through the second member 30.

Figure 11:
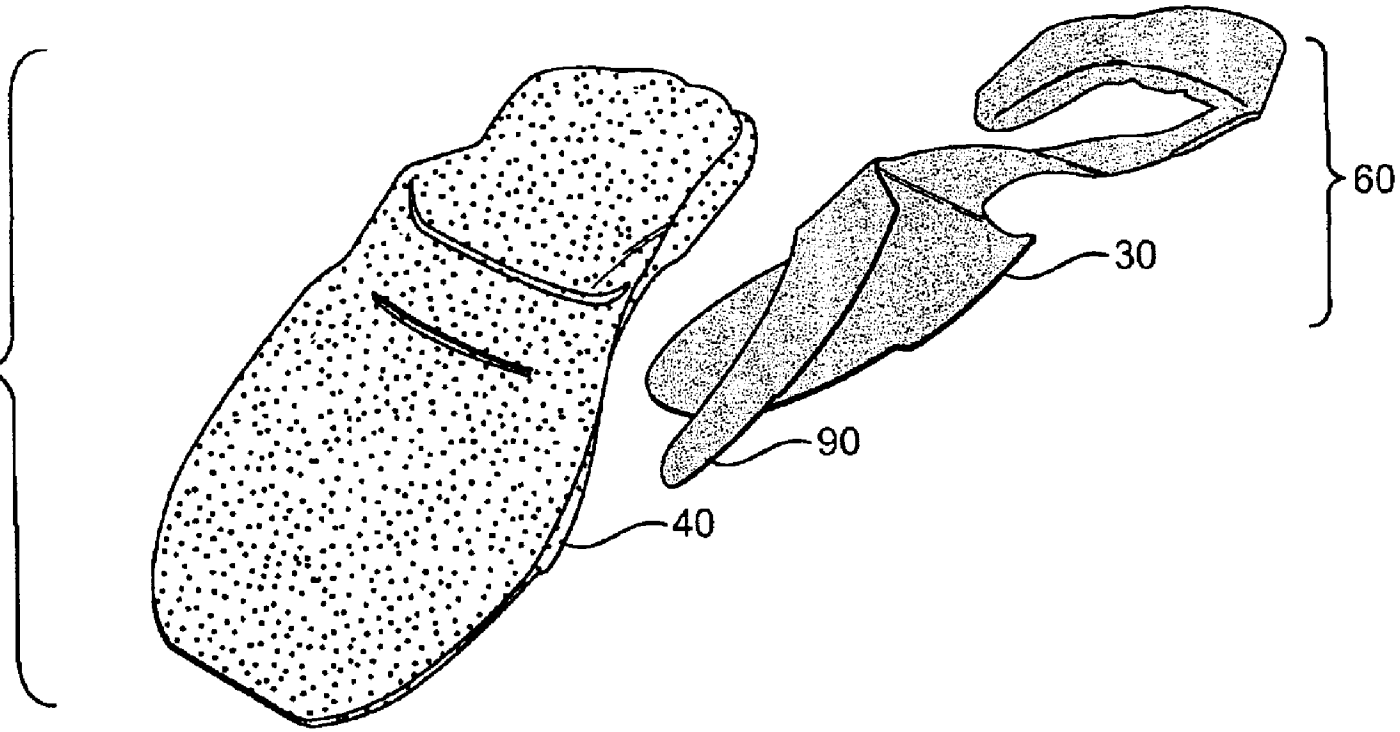

FIG. 11 shows one embodiment of the method of assembling a midsole for an article of footwear where a portion 90 of the first member 30 is folded before inserting the first member 30 through the opening in the second member 40. It can be appreciated that the first member 30 does not have to be folded before it is inserted through the opening in the second member. Accordingly, FIG. 11 shows only one of many methods of assembling the midsole by folding a portion of the first element 30.

Figure 12:
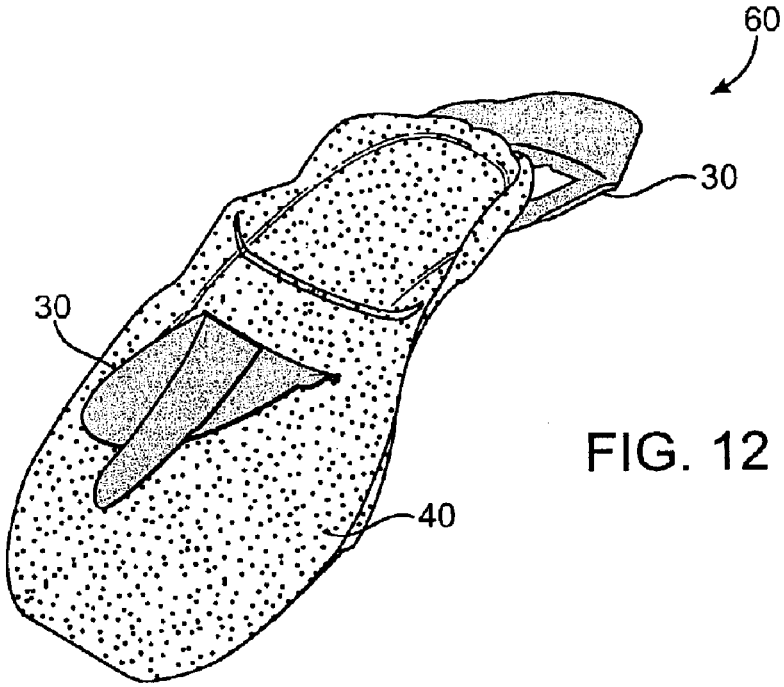

FIG. 12 shows the first member 30 being inserted through the opening 48 in the second member 40, wherein the first member 30 is positioned beneath the second member 40 in the heel and middle of the midsole and positioned above the second member 40 in the forefoot.

Figure 13:
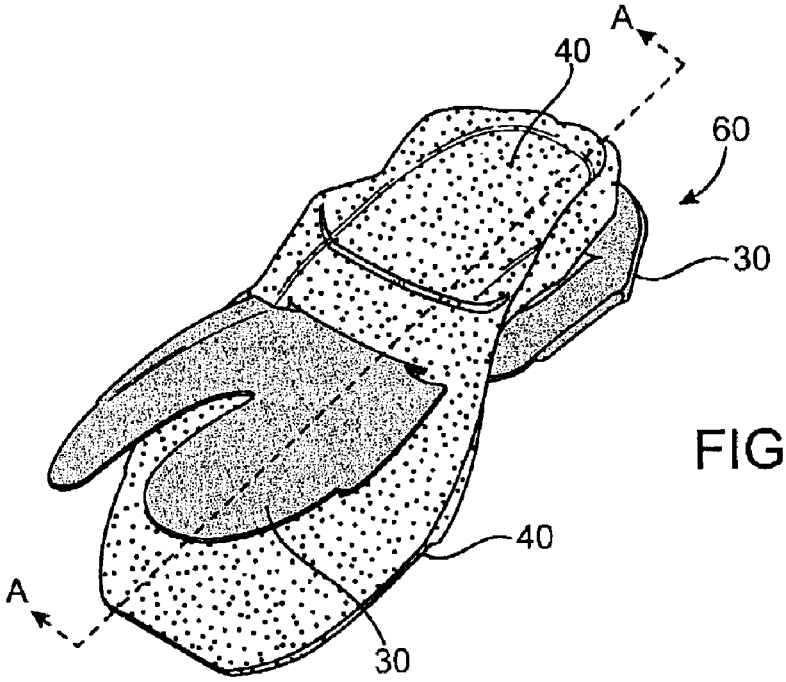

FIG. 13 shows the first member 30 and second member 40 after the first member 30 has been inserted through the opening 48 in the second member 40.

Figure 14:
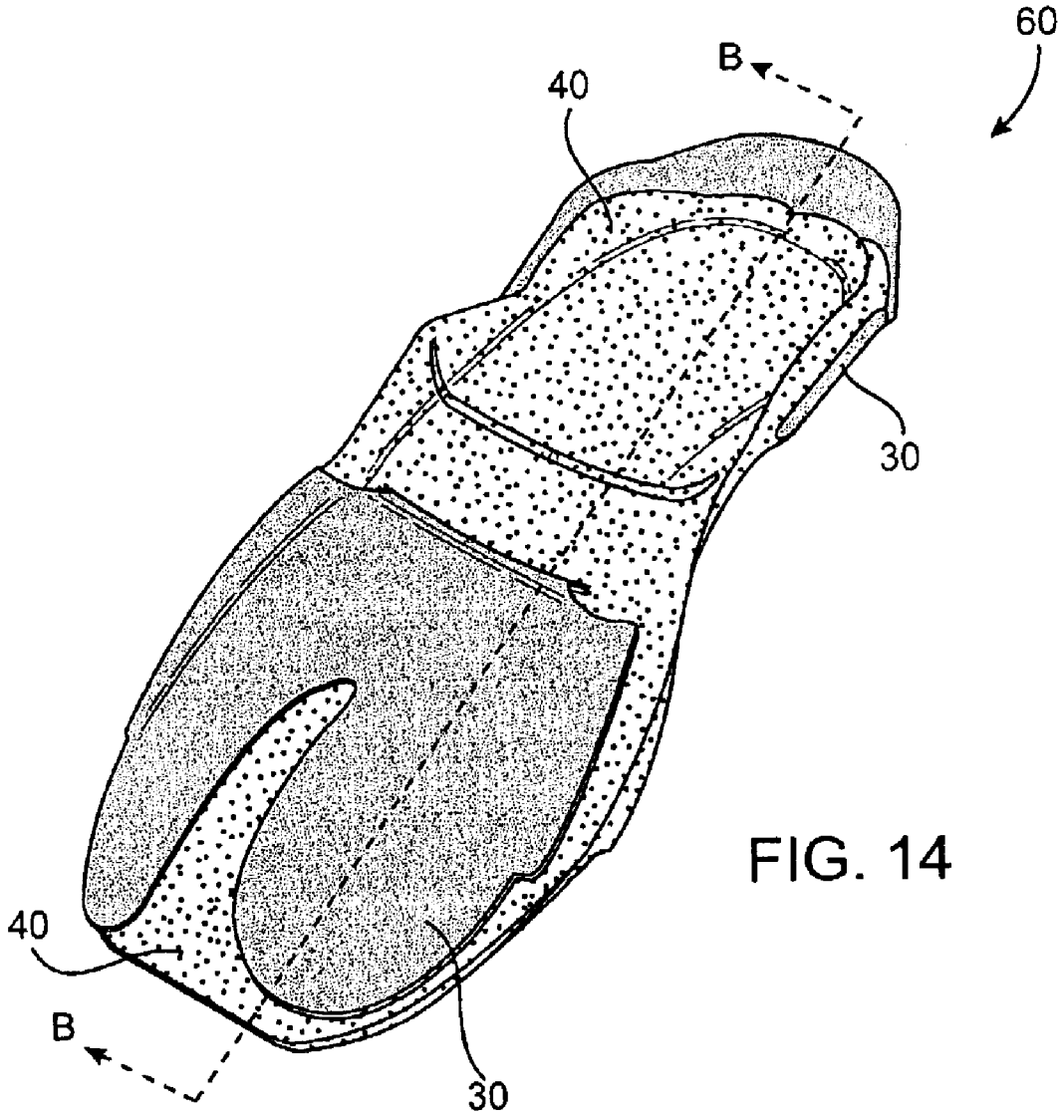

FIG. 14 shows the first member and second member combined to form a key hole midsole assembly 60.

Although in FIGS. 10–14, the method of assembling a midsole for an article of footwear shows the first member 30 or more rigid material being inserted through the key hole 48 opening of the second element 40 or foam-like material, it can be appreciated that the second element 40 can be inserted over the first member 30. In addition, although, the first member 30 is being inserted back to front in FIGS. 10–14, the first member 30 can be inserted in the opposite direction, front to back.

Figure 15:
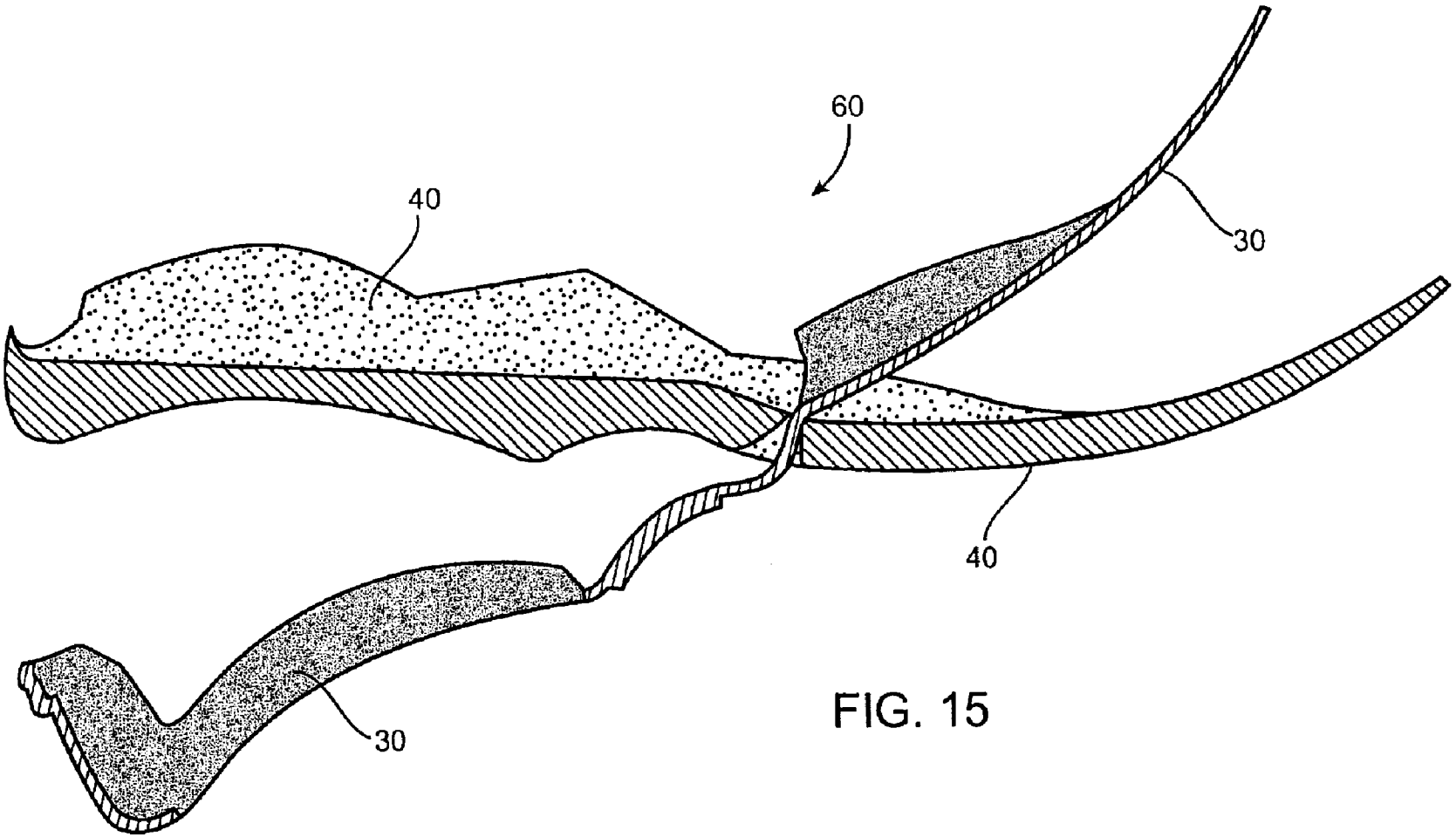
FIG. 15 is a cross-sectional view of the key hole midsole of FIG. 13 taken along the line A—A.

FIG. 15 shows a cross-sectional view of the key hole midsole 60 of FIG. 13 taken along the line A—A. The first member 30 as shown in FIG. 15 extends through the opening 48 in the mid portion 44 of the second member 40.

Figure 16:
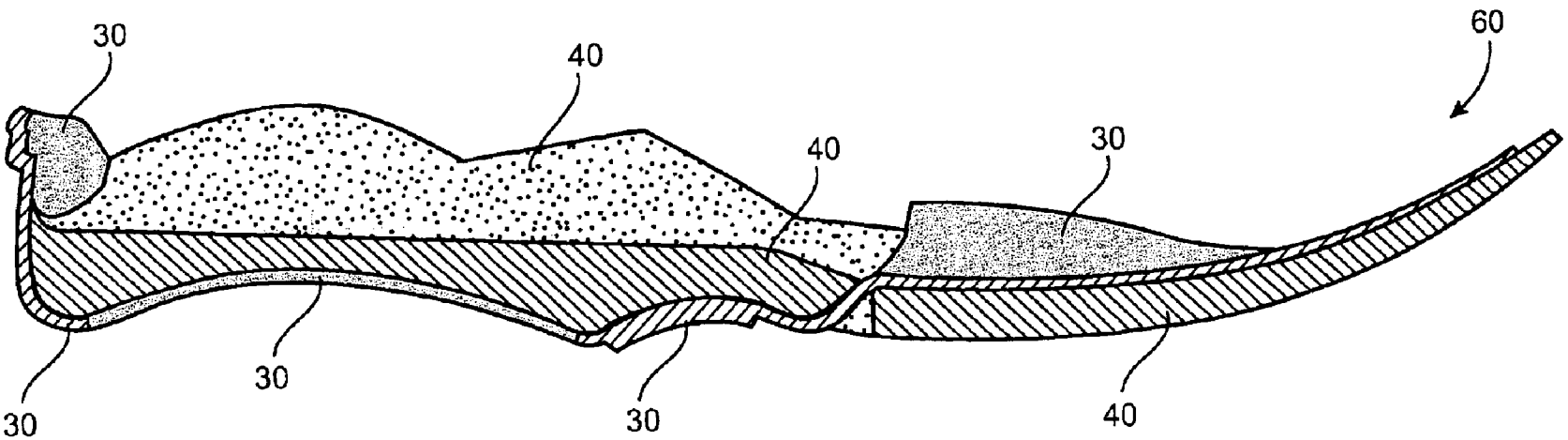
FIG. 16 is a cross-sectional view of the key hole midsole of FIG. 14 taken along the line B—B.

FIG. 16 shows a cross-sectional view of the key hole midsole 60 of FIG. 14 taken along the line B—B.

While the invention has been described in detail with reference to preferred embodiments thereof, it will be apparent to one skilled in the art that various changes can be made, and equivalents employed without departing from the invention.

We claim:

1. A midsole assembly for an article of footwear having a heel, a midsection and a forefoot, the midsole comprising:

a first member having a first hardness, the first member forming a continuous heel support, shank, and forefoot plate;

a second member having a second hardness, the second member forming a continuous heel cushion and forefoot cushion; and wherein the first member is positioned beneath the second member in the heel, and positioned above the second member in the forefoot.

2. The midsole assembly of claim 1, wherein the second member has an opening in a mid portion of the second member for positioning the first member through the opening in the second member.

3. The midsole assembly of claim 2, wherein the first member is completely surrounded by the second member at the location of the opening.

4. The midsole assembly of claim 1, further comprising a first cushion member located beneath the first member in the heel of the midsole.

5. The midsole assembly of claim 1, further comprising a second cushion member located above the first member in the forefoot of the midsole.

6. The midsole assembly of claim 1, wherein the first member is positioned beneath the second member in the midsection.

7. The midsole assembly of claim 1, further comprising an insole, an outer sole, and an upper for receiving the foot.

8. The midsole assembly of claim 1, wherein the first member has a durometer of approximately 25 to approximately 95 Shore D.

9. The midsole assembly of claim 1, wherein the first member is a semi-rigid material.

10. The midsole assembly of claim 1, wherein the second member is a microcellular foam material.

11. The midsole assembly of claim 10, wherein the first member is a semi-rigid plastic material.

12. The midsole assembly of claim 1, wherein the second member is resilient and compressible.

13. The midsole assembly of claim 1, wherein the first member has a variable hardness.

14. The midsole assembly of claim 1, wherein the hardness of the first member is greater than the hardness of the second member.

15. A midsole assembly for an article of footwear having a heel, a midsection, and a forefoot, the midsole comprising:

a semi-rigid member, the semi-rigid member forming a heel support, a shank, and a forefoot plate; and a foam member, the foam member forming a cushion portion in the heel and forefoot, the semi-rigid member is positioned beneath the foam member in the heel and the midsection, and wherein the semi-rigid member is positioned above the foam member in the forefoot.

16. The midsole assembly of claim 15, wherein the foam member has an opening in a mid portion of the foam member for positioning the semi-rigid member through the opening in the foam member.

17. The midsole assembly of claim 16, wherein the semi-rigid member is completely surrounded by the foam member at the location of the opening.

18. The midsole assembly of claim 15, further comprising a first cushion member located beneath the first member in the heel of the midsole.

19. The midsole assembly of claim 15, further comprising a second cushion member located above the first member in the forefoot of the midsole.

20. The midsole assembly of claim 15, wherein the semi-rigid member forms a continuous heel support, shank and forefoot plate.

21. The midsole assembly of claim 15, wherein the foam member forms a continuous heel cushion and forefoot cushion.

22. The midsole assembly of claim 15, further comprising an insole, an outsole, and an upper for receiving the foot.

23. The midsole assembly of claim 15, wherein the semi-rigid member has a durometer of approximately 25 to approximately 95 Shore D.

24. The midsole assembly of claim 15, wherein the foam member is a microcellular foam material.

25. The midsole assembly of claim 15, wherein the foam member is resilient and compressible.

26. The midsole assembly of claim 15, wherein the semi-rigid member is rigid.

27. A midsole assembly for an article of footwear having a heel, a midsection, and a forefoot comprising:

a first member having a first hardness, the first member forming a heel support and forefoot plate;

a second member having a second hardness, the second member forming a cushion in the heel and forefoot; and wherein the first member is positioned beneath the second member in the entire heel region and positioned above the second member in the entire forefoot region.

28. The midsole assembly of claim 27, wherein the first member forms a shank.

29. The midsole assembly of claim 27, wherein the first member is formed of a semi-rigid material.

30. The midsole assembly of claim 27, wherein the second material is resilient and compressible.

31. The midsole assembly of claim 27, wherein the second member has an opening in a mid portion of the second member for positioning the first member through the second member so that the first member is positioned above the second member in the forefoot of the assembly.

32. An article of footwear comprising:

an upper for receiving a foot of a wearer;

a midsole assembly for an article of footwear having a heel, a midsection and a forefoot, the midsole assembly comprising:

a first member having a first hardness, the first member forming a continuous heel support, shank and forefoot plate; and a second member having a second hardness, the second member forming a continuous heel cushion and forefoot cushion, wherein the first member is positioned beneath the second member in the heel and midsection, and positioned above the second member in the forefoot; and an outsole.

33. An article of footwear comprising:

an upper for receiving a foot of a wearer;

a midsole assembly for an article of footwear having a heel, a midsection and a forefoot, the midsole assembly comprising:

a semi-rigid member, the semi-rigid member forming a heel support, a shank and a forefoot plate; and a foam member, the foam member forming a cushion portion in the heel and forefoot, wherein the semi-rigid member is positioned beneath the foam member in the heel and the midsection, and positioned above the foam member in the forefoot; and an outsole.

34. A method of assembling a midsole for an article of footwear comprising:

forming a first member having a heel support, a shank, and a forefoot support;

forming a second member providing cushioning in the heel and forefoot, the second member having an opening in a mid portion of the second member for positioning the first member through the second member;

inserting the first member through the opening in the second member, wherein the first member is positioned beneath the second member in the heel and middle of the midsole and positioned above the second member in the forefoot; and combining the first member and second member to form a midsole assembly.

35. The method of claim 34, further comprising folding a portion of the first member before inserting the first member through the opening in the second member.

36. The method of claim 34, further comprising combining the midsole assembly with an upper and outsole to form an article of footwear.

37. A method of assembling a midsole for an article of footwear comprising:

forming a semi-rigid member having a heel support, a shank, and a forefoot support;

forming a soft foam member providing cushioning in the heel and forefoot, the soft foam member having an opening in a mid portion of the soft foam member for positioning the semi-rigid member through the soft foam member;

inserting the semi-rigid member through the opening in the soft foam, wherein the semi-rigid member is positioned beneath the soft foam member in the heel and middle of the midsole and positioned above the soft foam member in the forefoot; and combining the semi-rigid member and soft foam member to form a midsole assembly.

38. The method of claim 37, further comprising folding a portion of the semi-rigid member before inserting the first member through the opening in the soft foam member.

39. The method of claim 37, further comprising combining the midsole assembly with an upper and outsole to form an article of footwear.

* * * * *